United States Patent [19]

Cullen et al.

[11] 3,989,330

[45] Nov. 2, 1976

[54] ELECTRICAL KELLY COCK ASSEMBLY

[76] Inventors: Roy H. Cullen, 500 Jefferson, Houston, Tex. 77002; David E. Young, P.O. Box 58408, Houston, Tex. 77058

[22] Filed: Nov. 10, 1975

[21] Appl. No.: 630,441

[52] U.S. Cl. ..... 339/16 R; 339/59 R; 339/94 R

[51] Int. Cl.[2] ..... H01R 3/04

[58] Field of Search ..... 339/16 R, 15, 40, 42, 339/48, 59 M, 60 R, 60 C, 60 M, 94 R

[56] References Cited

UNITED STATES PATENTS

| | | | |
|---|---|---|---|
| 2,917,722 | 12/1959 | Cobbett et al. | 339/59 R |
| 3,816,641 | 6/1974 | Iversen | 339/94 R |
| 3,945,700 | 3/1976 | Didier | 339/59 M |

*Primary Examiner*—Roy Lake
*Assistant Examiner*—DeWalden W. Jones
*Attorney, Agent, or Firm*—Pravel & Wilson

[57] ABSTRACT

A kelly cock assembly adapted for connection within a tubular drill string above or below the kelly joint for controlling the flow of fluids through the drill string, wherein an electrical conductor means is provided for detachable interconnection with one or more electrical cables provided in the drill string for uninterrupted transportation of electrical energy between a location at the surface and a subsurface location without interferring with fluid flow control by the valve means of the assembly.

15 Claims, 4 Drawing Figures

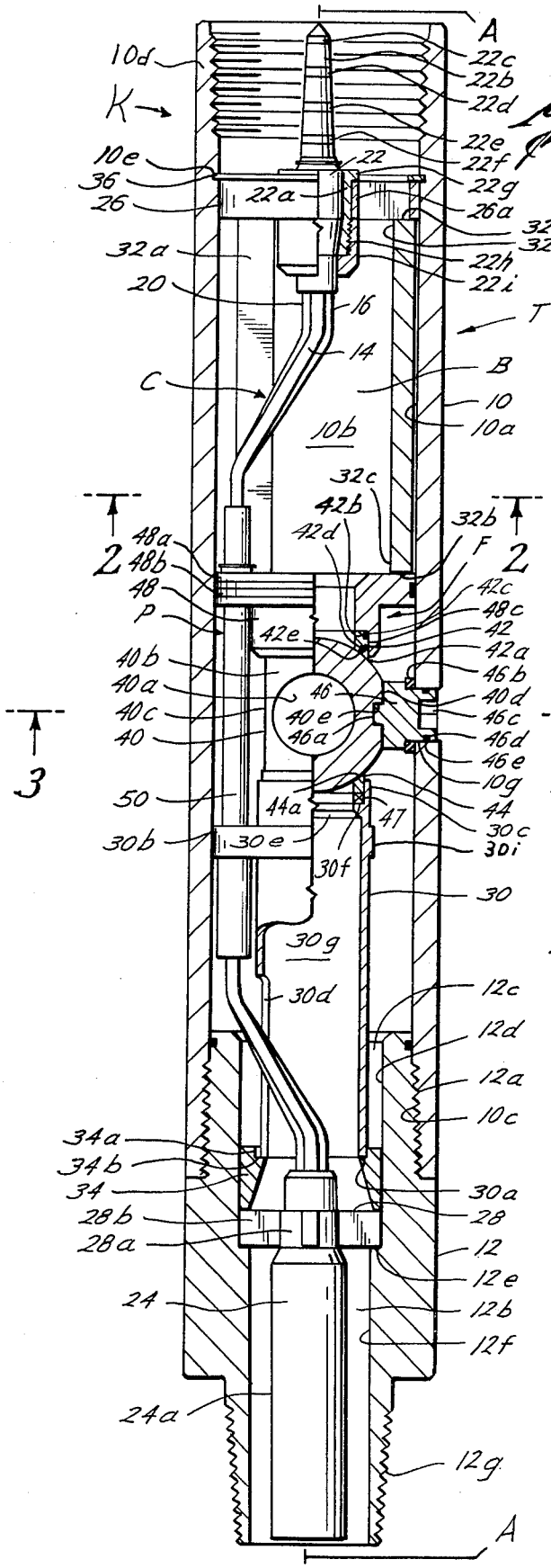
Fig. 1
Fig. 4
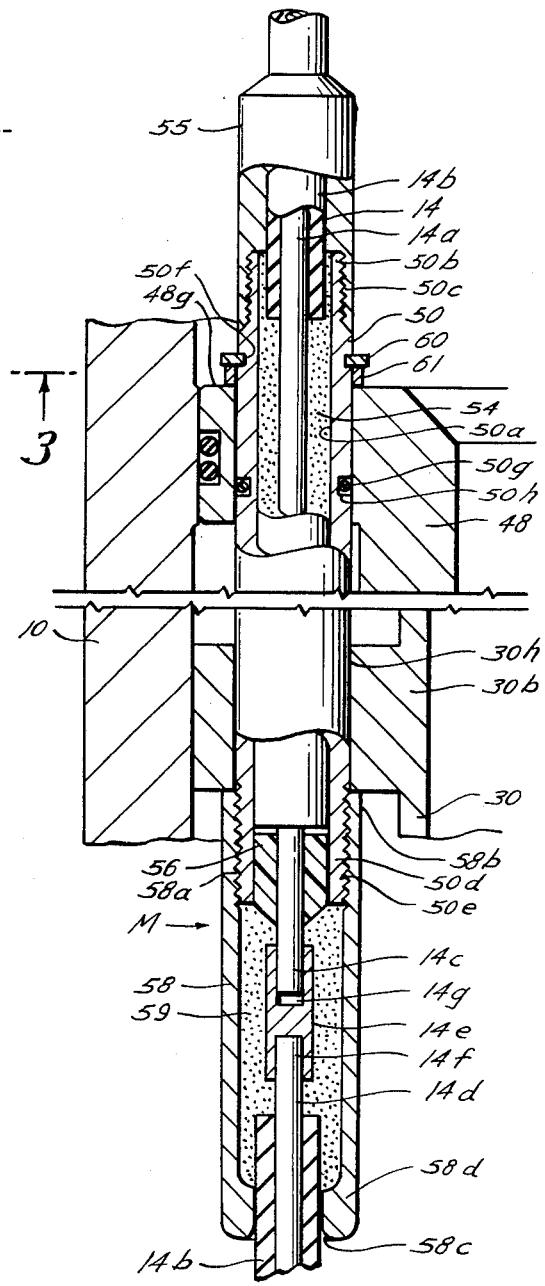

ELECTRICAL KELLY COCK ASSEMBLY

BACKGROUND OF THE INVENTION

This invention relates to a kelly cock valve assembly.

In carrying out well drilling operations it is a known practice in the art to transport electrical energy between the surface and a downhole location by positioning interconnected sections of electrical cable or the like within the tubular drill string to establish a continuous electrical path therebetween. However, when such techniques are employed a problem is presented in controlling the flow of well fluids through the tubular drill string, preventing internal blow-outs, and the like, for conventional kelly cock assemblies and similar internal safety valve assemblies cannot be interconnected in the drill string for conventional fluid flow control operation without interrupting the continuous electrical path provided by the interconnected electrical cables.

So far as is known, no one previously has provided a satisfactory kelly cock assembly or other internal safety valve assembly which solves such problem.

SUMMARY OF THE INVENTION

Accordingly, the present invention pertains to a new and improved kelly cock apparatus adapted for interconnection in a tubular drill string above or below a kelly joint thereof. The apparatus is provided with an electrical conductor means extending therethrough for interconnection with adjoining electrical cable sections provided in adjoining tubular members to provide a continuous electrical pathway through the kelly cock and tubular members therewith. Positioning means are provided for positioning the electrical conductor means around a fluid flow control means in the kelly cock so as to permit operation of the fluid flow control means simultaneously with the flow of electrical energy through the electrical conductor means.

BRIEF DESCRIPTION OF THE DRAWINGS

FIG. 1 is an elevational view, partially cut away and in cross-section, illustrating the preferred embodiment of the invention with the electrical cable conductor means positioned within and extending the length of the tubular body between the tubular body and a fluid flow control means so as to permit simultaneous control of fluid flow and transmission of electrical energy therethrough;

FIG. 4 is an elevational view, partially cut away and in cross-section, illustrating in detail the electrical cable conductor positioning means positioning a portion of one electrical cable conductor between the tubular member inner wall and the fluid flow control means of the assembly illustrated in FIG. 1.

DESCRIPTION OF THE PREFERRED EMBODIMENTS

Figure 2:
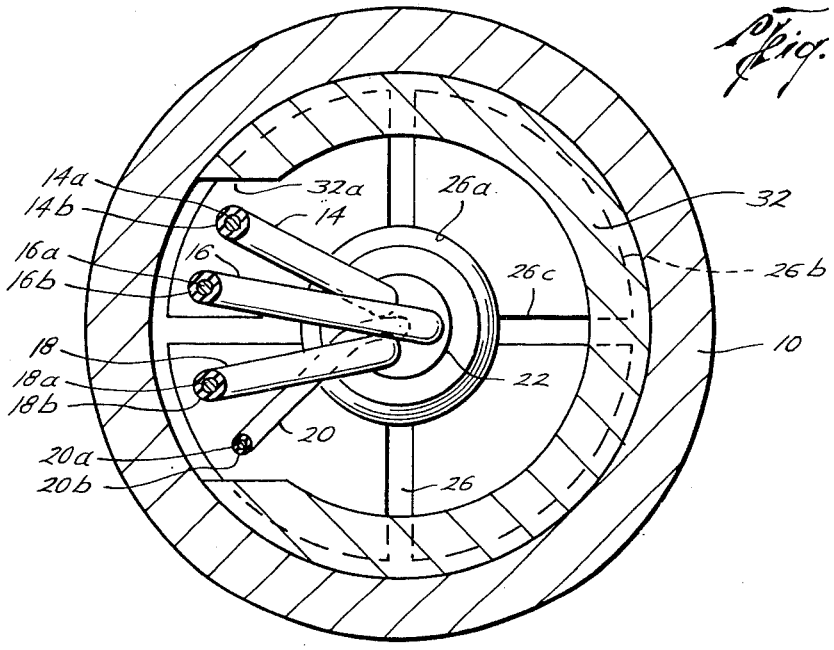
FIG. 2 is a cross-sectional view of the inventive apparatus taken along line 2—2 of FIG. 1 illustrating the electrical cable conductors extending from the axially aligned electrical cable terminal connector in side-by-side, spaced relationship within a slot of a spacer sleeve for spaced longitudinal parallel arcuate alignment adjacent the tubular body inner wall between the tubular body inner wall and the fluid flow control means.

In the drawings the letter K designates the electrical kelly cock assembly of this invention, which is comprised of a tubular body T having a longitudinal bore B therethrough, a fluid flow control means F and an electrical cable conductor means C, each respectively mounted within the bore B. The electrical cable conductor means C extends the longitudinal length of the bore B for transmitting electrical energy therethrough. Positioning means P is also provided for positioning a portion of the electrical cable conductor means C in the tubular body T but disposed to one side of the fluid flow control means F so that the fluid flow control means F can be operated, as will be explained in detail.

The kelly cock assembly K is adapted for interconnection in a tubular drill string with drill pipe joints, a kelly joint, and the like, prewired with interconnected lengths of electrical cable either above or below the kelly joint. The kelly cock assembly K may be operated to control the flow of fluids within the tubular drill string to prevent internal blowouts and/or pressure kicks therethrough, and the like, simultaneously with the transportation of electrical energy between the surface and a subsurface location, as will be more fully explained.

Considering the invention in more detail, the tubular body T is preferably cylindrical in shape with a length for convenient handling and interconnection in a tubular drill string, and has a cross-sectional diameter of a size sufficient to permit its passage through annular blowout preventors, the rotary table, and like apparatus conventionally employed in normal well drilling operations. The tubular body T may be formed in one or more sections which are threaded or otherwise coupled together for convenience in manufacture, assembly, repair and the like. As illustrated in FIG. 1, the tubular body T is preferably conveniently made up of a main tubular body section 10 having a cylindrical inner wall 10*a* defining a longitudinal main bore 10*b*, and a tubular body supporting section 12 threadably connected with one end of the main body section 10 in a conventional manner, such as by cooperative engagement of internal threads 10*c* and external threads 12*a*. The tubular body support section 12 has a side wall thickness greater than that of the main tubular body section and is provided with a longitudinal bore 12*b* and an enlarged longitudinal counterbore 12*c* which are longitudinally coextensive with each other and with the main body section bore 10*b* so as to form the longitudinal extending bore B. More particularly, the counterbore 12*c* is defined by the support body portion 12*d* and an upwardly facing annular shoulder 12*e*, and has a cross-sectional diameter smaller than the cross-sectional diameter of the main tubular body bore 10*a*. Similarly, the longitudinal bore 12*b* is defined by the support body inner wall portion 12*f* and has a cross-sectional diameter smaller than the support body counterbore 12*c*, as illustrated in FIG. 1.

An inwardly threaded box end 10*d* is provided with the main tubular body section 10 for threaded connection with an externally threaded pin end of the lower end of an adjoining drill pipe or kelly joint in the conventional manner (not shown). Similarly, the tubular body support section 12 has an externally threaded pin end 12*g* adapted for connection with a box end of a lower pipe or kelly joint of the drilling string for interconnecting the kelly cock assembly in the drill string (also not shown).

As illustrated in FIG. 1, the electrical cable conductor means C extends substantially the entire longitudinal length of the tubular body T within the tubular body bore B, and includes a plurality of longitudinally extending insulated electrical conductors 14, 16, 18 and 20 which are integrally connected at their respective opposing ends with male and female-type electrical terminal connectors 22 and 24. These terminal connectors 22 and 24 are axially mounted adjacent the main tubular body section box end 10*d* and the support body section pin end 12*g*, respectively, and face longitudinally in opposing directions for interconnection in a known manner with like connectors of adjoining prewired drill pipe joints, a kelly joint or the like.

Preferably, at least three conductors, 14, 16 and 18, are provided which include an electrical energy transporting metallic core or wire 14*a*, 16*a*, 18*a* of sufficient size to transport electrical power between the surface and a downhole or subsurface location for powering a downhole electrical drilling apparatus or the like. Additionally, a fourth conductor, 20, including a metallic core or wire 20*a* of a smaller size sufficient to transport telemetry signals between the surface and a subsurface location is provided. Each of the conductors further include a concentric layer of suitable insulating material, 14*b*, 16*b*, 18*b* and 20*b*, respectively, preferably a conventional elastomeric insulating material (FIG. 2).

Figure 3:
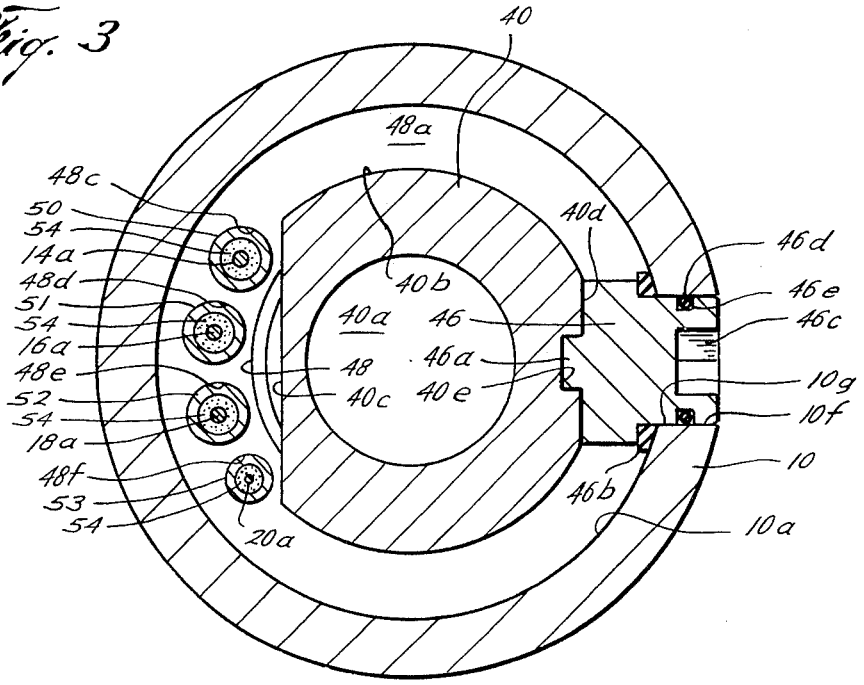
FIG. 3 is a cross-sectional view taken along line 3—3 of FIG. 1 but having the spherical flow closure element of the flow closure means shown rotated to an open position for passage of fluids through the tubular body and illustrating the electrical cable conductors and conductor positioning means positioned between the tubular body and the flow control element of the flow control means in spaced longitudinal parallel alignment.

As illustrated in FIGS. 1 and 2, the electrical conductors 14, 16, 18 and 20 extend substantially laterally from each of the axially mounted male and female terminal connectors towards the main tubular body section inner wall 10*a* and are positioned in spaced, side-by-side longitudinal parallel alignment with each other between the main tubular body section inner wall 10*a* and the fluid flow control means F. More particularly, the central portions of the conductors 14, 16, 18 and 20 are positioned substantially equidistant adjacent the inner wall 10*a* in longitudinally, parallel alignment therewith and extend between it and the fluid flow control means F in the aforementioned side-by-side longitudinal parallel alignment (FIG. 3). Such central portions of the conductors 14, 16, 18 and 20 are fixedly held in such alignment separate from the tubular body bore B between the inner wall 10*a* and fluid flow control means F by the positioning means P as described hereafter.

The male and female-type terminal connectors 22, 24 may be of any conventional construction which permits rapid interconnection of the electrical cable conductor means C with electrical cable sections provided with the adjoining kelly joint, tubular drill pipe sections and the like upon interconnection of the kelly cock K into a prewired tubular drill string. Preferably, the male-type connector 22 includes a body 22*a* and a tapered protrusion 22*b*. A plurality of outwardly facing annular contact rings 22*c*, 22*d*, 22*e* and 22*f* are provided on the protrusion 22*b* which are integrally connected in a known manner to the electrical conductors 14, 16, 18 and 20. On the other hand, the female connector 24 includes a longitudinal tubular body 24*a* having a longitudinal truncated bore (not shown) which is adapted to receive the protrusion similar to 22*b* of a terminal connector mounted in an adjoining tubular drill pipe or kelly joint. Additionally, the female connector 24 is provided with inwardly facing annular contact rings (also not shown) integrally mounted in a known manner with the connectors 14, 16, 18 and 20 which are adapted to engage the outwardly facing contact rings similar to 22*c*, 22*d*, 22*e* and 22*f* to provide electrical continuity through the tubular drill string.

Each of the terminal connectors 22 and 24 face longitudinally outwardly so as to provide the aforementioned interconnection with similar terminal connectors and are held in the aforementioned axial alignment by means of support members 26 and 28, respectively. The connector support member 26 includes an inner annular ring 26*a*, mounted with the connector body 22*a* and a concentric outer annular ring 26*b*, which are, respectively, fixedly interconnected by means of a plurality of equal length radial blades 26*c*. The outer annular ring has an outer diameter slightly less than that of the tubular body bore 10*b* and slidably engages the inner wall 10*a*. The support member 28 may be of similar construction, but preferably only includes an inner annular ring 28*a* mounted with the female connector body 24*a* and a plurality of equal length radial blades 28*b*. The female support member 28 is received in the tubular body support section counterbore 12*b* wherein the radial blades 28*b* engage and are supported by the upwardly facing annular shoulder 12*e*. The support members 26 and 28 thus position the terminal connectors 22 and 24 in alignment with the longitudinal axis A of the tubular body T adjacent each end 10*d* and 12*g* while permitting the passage of fluids through the tubular body longitudinal bore B between the radially extending blades 26*c* and 28*b*.

The terminal connectors 22 and 24 may be fixedly mounted with the respective support members 26 and 28 in any conventional manner. As illustrated, the male terminal connector body 22*a* may include an outwardly extending annular flange 22*g*, an annular threaded portion 22*h* and an inwardly threaded nut 22*i*. Upon positioning the terminal connector body 22*a* within the support member annular inner ring 26*a* and tightening the nut 22*i* in a known manner, the nut 22*i* and the outwardly extending flange 22*g* engage the support member annular inner ring 26*a* on opposite sides and thereby fixedly mount the terminal connector 22 therewith. A similar arrangement (not shown) is provided to fixedly interconnect the female connector 24 with its support member 28.

A pair of longitudinal tubular spacer sleeves 30, 32 are provided for supporting and positioning the fluid flow control means F and cable conductor positioning means P within the tubular body bore B substantially centrally from the tubular body end 10*d* and 12*g*. As shown in FIG. 1, the tubular spacer sleeves 30 and 32 are respectively disposed on opposing sides of the fluid flow control means F and extend longitudinally concentrically about the tubular body axis A in substantially parallel alignment therewith and with each other. The upper spacer sleeve 32 has an outer cross-sectional diameter slightly smaller than the main tubular body bore 10*b* and slidably engages the main tubular body inner wall 10*a*. The lower spacer sleeve 30 has a smaller cross-sectional diameter so as to permit its lower end 30*a* to be received and supported within the tubular body support section counterbore 12*b*, as shown.

Preferably, an annular support ring 34 having an inwardly and upwardly facing annular groove 34*a* for receiving the lower sleeve lower end 30*a* is positioned within the counterbore 12*b* on top of and in engagement with the female terminal connector support member 28. The lower sleeve lower end 30*a* is received in the annular ring inner groove 34*a* engaging the upwardly facing annular shoulder 34*b* whereby it is fixedly supported for the aforementioned parallel alignment concentrically about the tubular body longitudinal axis A. Additionally, the lower spacer sleeve 30 has an outwardly extending flange 30*b* slightly below its upper end 30*c* which engages the main tubular body inner wall 10*a* so as to position the lower sleeve upper end 30*c* concentrically about and in substantially parallel alignment with the tubular body longitudinal axis A. The flange 30*b* is cut-away on one side to provide a planar surface 30*i* (FIG. 1) to facilitate assembly.

The upper spacer sleeve 32 has a longitudinal slot 32*a* extending its entire length substantially parallel with the tubular body longitudinal axis A while the lower spacer sleeve 30 is provided with an opening 30*d* below its outwardly extending annular flange 30*b* which extends to its lower end 30*a*. The longitudinal slot 32*a* and lower sleeve opening 30*d* are positioned in substantially parallel longitudinal alignment with each other so as to permit the electrical cable conductors 14, 16, 18 and 20 to extend therethrough for the aforementioned side-by-side spaced longitudinal parallel alignment arcuately adjacent the main tubular body inner wall 10*a*.

As shown, the upper spacer sleeve 32 engages the fluid flow control means F at a downwardly facing annular shoulder 32*b* formed at its lower end 32*c* while its upper end 32*d* provides an upwardly facing annular shoulder 32*d* which engages and supports the male connector support member annular peripheral ring 26*b*. Such engagement is maintained by an annular snap ring 36 received in an inwardly facing annular groove 10*e* of the main tubular body 10 also engaging the support member annular peripheral ring 26*b* on its opposing side.

As illustrated in FIGS. 1 and 2, the fluid flow control means F comprises a rotatably shiftable ball-type flow closure element 40 provided with a bore 40*a* and having a spherical outer sealing surface 40*b* disposed between a pair of annular valve seats 42, 44 having smooth annular seating surfaces 42*a*, 44*a*, respectively, in sealing engagement with the closure element spherical outer sealing surface 40*b*. The spherical closure element 40 also has its laterally opposite sides cut away externally to provide two opposite parallel planar surfaces 40*c* and 40*d* spaced unequal distances from the closure element bore 40*a* for providing a sufficient amount of space between the planar surface 40*c* and the main tubular body inner wall 10*a* for the electrical conductor portions and conductor positioning means P. Further, an outwardly opening operating recess 40*e* is formed in the opposing planar surface 40*d* for receiving a projection 46*a* of a valve operating member 46.

The valve operating member 46 is rotatably mounted with the main tubular body section wall 10 in a conventional manner, such as by employing a conventional bearing or bushing mount 46*b* and extends through an opening 10*f* in the tubular body side wall 10 so as to permit the flow closure element 40 to be rotated by external operation. A suitably shaped recess 46*c* is provided for receiving a suitable tool (not shown) for such external operation. Additionally, an annular seal 46*d*, such as a conventional O-ring made of conventional sealing material, is received in an outwardly facing annular groove 46*e* for sealing engagement with the surface 10*g* forming the side wall opening 10*f* to prevent leakage of fluids therethrough.

The lower annular valve seat 44 is supported by the lower spacer sleeve 30 at its upper end 30*c*. More particularly, the lower annular valve seat 44 has an outer diameter slightly smaller than the lower spacer sleeve 30 inner diameter which has an inwardly facing annular flange 30*e* forming an upwardly facing shoulder 30*f* adjacent its upper end 30*c* for supporting the annular lower valve seat 44. Preferably, an annular resilient member 47, made of a suitable resilient material such as rubber, is provided between the annular shoulder 30*f* and the lower valve seat 44 to provide contact force between the valve seat annular surface 44*a* and the closure element outer spherical surface 40*b*.

Further, the upper annular valve seat 42 is carried by an annular valve seat carrier member 48 having an outwardly projecting annular collar 48*a* carrying a suitable sealing means 48*b*, such as one or more conventional O-ring seals made of conventional sealing material, on its outer annular peripheral edge for sealing engagement with the main tubular body inner wall 10*a* so as to prevent fluid flow therebetween. As shown, the upper annular valve seat 42 is received in an inwardly and downwardly facing annular groove 48*c* provided with the valve seat carrier 48. Preferably, the upper valve seat 42 is provided with an outwardly facing annular groove 42*b* carrying a suitable annular sealing means 42*c*, such as an O-ring seal, for sealing engagement with the valve seat carrier annular groove 48*c* and an annular recess 42*d* in its smooth annular seating surface 42*a* also carrying such suitable sealing means 42*e* for sealing engagement with the closure element spherical outer sealing surface 40*b*. Such sealing means 42*c* and 42*e* cooperate with the peripheral seal 48*b* carried by the valve seat carrier collar 48*a* to form a bulkhead to prevent the passage of fluids through the tubular body bore B of the apparatus K except through the closure element counterbore 40*a* when the closure element 40 is rotated to a position where the closure element bore 40*a* is coextensive with the main tubular body bore 10*a* above the valve seat carrier 48 and the longitudinally extending bore 30*g* formed by the lower spacer sleeve member 30.

As previously mentioned, the positioning means P fixedly positions the central portions of the electrical conductors 14, 16, 18 and 20 between the fluid flow control means F and the main tubular body section inner wall 10*a* in spaced longitudinal parallel relationship therewith and with each other, respectively. As illustrated in the drawings, the positioning means P includes a plurality of substantially rigid longitudinally extending tubular members 50, 51, 52 and 53, each having one of the electrical conductor metallic wires 14*a*, 16*a*, 18*a* or 20*a* extending longitudinally therethrough substantially along each tube's longitudinal axis. Each of the substantially rigid tubes 50, 51, 52 and 53, preferably made of steel, are aligned in substantially spaced parallel longitudinal alignment with respect to each other, with the longitudinal axis A of the tubular body T and the inner wall 10*a* and extend through an equal plurality of longitudinally aligned openings 48*c*, 48*d*, 48*e* and 48*f* (FIG. 3) and 30*h* (FIG. 4), respectively, provided in the valve seat carrier collar 48 and the lower spacer sleeve annular flange 30*b* (other openings identical to 30*h* not shown). Such alignment means positions the substantially rigid tubular members 50 in arcuate spaced longitudinal alignment with the main tubular body inner wall 10*a*. Additionally, such alignment means positions the tubular bodies 50, 51, 52 and 53 longitudinally between the tubular body inner wall 10*a* and the planar surface 40*c* of the spherical flow closure element 40 so rotation of the flow closure element 40 is uninterrupted by such bodies 50, 51, 52 and 53 or the conductors therewith (FIG. 3).

In the drawings, the details of the positioning means P are illustrated for positioning only one of the conductors, 14 (FIG. 3). However, identical construction is similarly provided for such positioning of each of the other conductors 16, 18 and 20. For the purpose of brevity, only the details illustrated will be fully described herein.

Referring now to FIG. 3 of the drawings, the rigid tubular member 50 has the electrical conductor metallic core or wire 14*a* extending longitudinally therethrough along its longitudinal axis. A concentric layer 54 of a suitable potting compound, such as epoxy cement, is provided in the annular space between the conductor wire 14*a* and the tubular member inner wall 50*a* to fixedly position the conductor wire 14*a* therein and to provide additional rigid support. Preferably, the potting compound concentric layer 54 extends substantially the entire length of the rigid tube 50 and also surrounds a portion of the conductor concentric insulation layer 14*b* which is extended through the tube upper end 50*b* a desired distance.

Similarly, a concentric layer 55 of a suitable elastomeric material is provided about the insulated conductor 14 and the rigid tube upper end 50*b* which forms a fluid-tight seal with the rigid tube upper end 50*b* and reinforcement protection to the conductor 14. The elastomeric concentric layer 55 may be of the same type of elastomeric insulating material as the conductor insulating layer 14*b* and may be integrally molded thereto. Additionally, the rigid tube upper end 50*b* is preferably provided with exterior annular threads 50*c* so as to improve adhesion or interconnection of the elastomeric concentric layer 55 thereto and form the aforementioned fluid-tight seal therebetween.

For convenience in construction, assembly, etc., the conductor wire 14*a* is segregated and connector means M are provided for conductor wire interconnection and for fixedly mounting the rigid tube 50 with the valve seat carrier collar 48 and the lower spacer sleeve annular flange 30*b*. As shown, the electrical conductor wire 14*a* extends longitudinally outwardly from the rigid tube lower end 50*d* where it is segregrated and thus, forms a male-type electrical connector 14*c*. A concentrically mounted annular seal 56 of suitable elastomeric sealing material is provided to prevent leakage of fluids through the tube 50 which is disposed between the conductor wire 14*a* and the tube lower end 50*d*. The remainder electrical conductor wire lower portion 14*d*, integrally connected with the axially mounted female terminal connector 24 (FIG. 1), has a second female connector 14*e* integrally connected with its opposing end 14*f* having a recess 14*g* for receiving the formed male-type connector 14*c*.

A connector nut 58 having the lower conductor wire female-type connector 14*e* mounted therein is provided which is adapted for threadable connection with the rigid tube lower end 50*d* by means of cooperative rotating engagement of inwardly facing annular threads 58*a* and outwardly facing annular threads 50*e* provided, respectively, with the nut upper end 58*b* and tube lower end 58*d*. The conductor wire lower portion 14*d* and its concentric insulation layer 14*b* extend through a longitudinal opening 58*c* provided in the connector nut lower end 58*d* and is held in substantially axial alignment therewith by means of a concentric layer of potting material 59, such as epoxy cement, mentioned hereinbefore.

Electrical cable conductor wire interconnection and fixed positioning of the rigid tube 50 can thus be accomplished by threadably interconnecting the threads 58*a* and 50*e* and rotating the connector nut 58 relative to the rigid tube 50. During such rotation, the connector nut upper end 58*b* engages the lower spacer sleeve annular flange 30*b* and an annular snap ring 60 received in an outwardly facing annular groove 50*f* of the rigid tube 50 engages an also provided annular spacer 61 which in turn engages the valve seat carrier collar upper surface 48*d*. Such engagement of respective elements forcibly retains the rigid tube in the described position.

Simultaneously during such rotation the conductor wire male-type connector 14*c* is received and engages the female-type connector 14*e* to provide electrical continuity through the conductor wire 14*a*. Further, the elastomeric seal 56 engages the connector nut potting compound concentric layer 59 to provide a fluid-tight seal and thus, prevents leakage of fluids inwardly through the rigid tube 50.

In order to prevent fluid leakage through the valve seat carrier collar opening 48*c*, the rigid tube 50 carries an annular seal 50*g*, such as a conventional O-ring of resilient material, in an outer annular groove 50*h* which sealingly engages the valve seat carrier collar 48. Such sealing engagement further establishes the aforementioned bulk-heading of fluid flow through the tubular body bore B.

As previously mentioned, identical construction is similarly provided for fixedly positioning each of the other conductors 16, 18 and 20 and tubular bodies 51, 52 and 53, respectively, between the tubular section inner wall 10*a* and flow control element planar surface 40*c*.

OPERATION

As mentioned hereinbefore, the kelly cock apparatus K of this invention is particularly adapted for interconnection into a prewired tubular drill string so as to provide the flow of electrical energy from the surface to a subsurface location simultaneously with the control of fluids through the tubular drill string. The kelly cock apparatus K of this invention may be threadably interconnected into a tubular drill string in a conventional manner as described hereinbefore. During such threadable interconnection the male terminal connector 22 and female terminal connector 24 respectively interconnect with similar female and male-type interconnectors provided with electrical cable sections of adjoining pre-wired drill pipe joints or a prewired kelly joint. Such interconnection establishes the aforementioned electrical continuity for transportation of electrical energy through the tubular drill string.

Upon interconnection into the tubular drill string the flow of fluids therethrough may be controlled by rotation of the ball-type spherical flow control element 40.

Fluid flow is established by rotation of the closure element 40 to a position (as shown in FIG. 3) where the element's bore 40*a* is coextensive with the tubular body main section bore 10*b* and the lower spacer sleeve bore 30*g*. As known, such fluid flow control is particularly beneficial in preventing fluid pressure kickbacks or internal blowouts and to permit interconnection of other drill pipe joints into the tubular drill string without loss of fluid.

The foregoing disclosure and description of the invention are illustrative and explanatory thereof, and various changes in the size and shape as well as in the details of the illustrative construction may be made without departing from the spirit and scope of the invention.

We claim:

1. A kelly cock apparatus adapted for connection in a tubular drill string above or below a kelly joint of said tubular drill string, said tubular drill string being provided with one or more sections of an electrical cable interconnected therethrough for the transfer of electrical energy between a location substantially at the surface and a subsurface location in a well, said apparatus comprising:

a tubular body having a longitudinal bore therethrough and also having connector means at each end for connecting the tubular body with adjoining tubular members within said tubular drill string;

fluid flow control means mounted within the tubular body for controlling the flow of fluids through said bore;

electrical conductor means extending within and longitudinally of the tubular body and having electrical terminal connector means at each end substantially adjacent the tubular body connector means for detachable interconnection with electrical cable sections provided with adjoining tubular members of the drill string for transmitting electrical energy therethrough; and means for positioning said electrical conductor means in said tubular body separately from said fluid flow control means so as to permit control of the flow of fluids through said bore by said fluid flow control means simultaneously with the flow of electrical energy through said conductor means.

2. The apparatus of claim 1, wherein the electrical conductor means includes at least one insulated electrical conductor extending substantially the length of the tubular body and connected at each end with said electrical terminal connector means.

3. The apparatus of claim 2, wherein the electrical conductor means includes a plurality of insulated electrical conductors extending substantially the length of the tubular body and connected at each of the opposing ends thereof with said terminal connector means, and wherein said conductor positioning means includes:

means for substantially fixedly positioning a portion of each of said electrical conductors between the fluid control means and the tubular body inner wall in spaced substantially parallel longitudinal relationship relative to each other and to the tubular body inner wall.

4. The apparatus of claim 3, wherein said conductor positioning means further positions said electrical conductor portions inwardly substantially arcuately adjacent the tubular body inner wall.

5. The apparatus of claim 3, wherein the conductor positioning means includes:

reinforcing means for reinforcing a portion of each conductor positioned between the fluid control means and the tubular member inner wall.

6. The apparatus of claim 3, wherein the conductor positioning means includes:

a plurality of substantially rigid tubular members fixedly mounted and extending substantially longitudinally between the tubular body inner wall and the fluid flow control means in substantially parallel spaced relationship relative to each other, each of said substantially rigid tubular members having one of said conductors extending longitudinally substantially axially therethrough and having a composite reinforcing and insulating material filled in an annular space between each conductor and each tubular member inner wall.

7. The apparatus of claim 3, including:

connector means for detachable interconnection of a portion of each electrical conductor connected with one of the electrical terminal conductor means with the portion of each electrical conductor substantially fixedly positioned between the tubular body inner wall and the fluid control means.

8. The apparatus of claim 1, including:

support means for supporting each of said electrical terminal connector means in substantially axial alignment with the tubular body substantially adjacent each of the tubular body connector means, respectively.

9. The apparatus of claim 1, including:

retainer means for retaining said fluid flow control means in a substantially fixed position between the tubular body ends within the tubular body bore.

10. The apparatus of claim 9, wherein the retainer means includes:

a pair of spacer sleeve members respectively positioned on opposite sides of the fluid flow control means within the tubular body bore, each of the retainer sleeve members respectively extending between the fluid flow control means substantially longitudinally within the bore and the opposing ends of said tubular member, respectively, in longitudinal parallel alignment with each other and with the tubular body axis; and means for holding each of said spacer sleeve members within the tubular body bore.

11. The apparatus of claim 10, wherein:

one of said spacer sleeve members has an outer cross-sectional size slightly smaller than the tubular member bore cross-sectional size and is provided with a longitudinal slot extending the entire length thereof; and the other of said spacer sleeve members has an outer cross-sectional size smaller than the cross-sectional size of the tubular member bore forming an annular space therebetween and is provided with an opening;

said longitudinal slot and said opening of the respective spacer sleeve members being aligned substantially longitudinally with respect to each other for receiving the electrical cable conductor means for positioning a portion thereof inwardly between the tubular body inner wall and the fluid flow control means positioned between said spacer sleeve members.

12. The apparatus of claim 11, including:

support means for supporting each of said electrical terminal connector means in substantially axial alignment with the tubular body substantially adjacent each of the tubular body connector means, respectively; and said electrical conductor means includes a plurality of electrical conductors extending between said electrical terminal connector means through the spacer sleeve opening, between the tubular body inner wall and the fluid flow control means substantially adjacent the tubular member inner wall and in spaced parallel longitudinal alignment with respect to each other, and through the longitudinal slot of the slotted spacer sleeve member.

13. The apparatus of claim 12, wherein the fluid flow control means includes:

a rotatably shiftable fluid flow closure element having an opening for the passage of fluid therethrough and having a spherical outer sealing surface with a pair of substantially parallel opposing planar surfaces to provide suitable clearance between said closure element and the tubular member outer wall;

a pair of annular valve seat members sealingly engaging the closure element spherical sealing surface, respectively, said annular valve seat members being disposed opposite each other with said closure element positioned therebetween;

means for rotating the closure element for controlling the passage of fluids therethrough, said means being rotatably mounted with and extending through the tubular body and having operating means received in an access provided with the closure element for causing rotation therewith; and an annular valve seat carrier member sealingly engaging one of said annular valve seat members, said valve seat carrier having an outwardly projecting annular collar sealingly engaging the tubular member inner wall providing a fluid tight seal therebetween;

said valve seat carrier annular collar engaging said slotted spacer sleeve member and said other annular valve seat member engaging said spacer sleeve member having said opening, respectively, for substantially fixedly positioning said rotatable flow closure element therebetween whereby fluid flowing through said tubular member within the spacer sleeve is controlled by the rotation of said closure element.

14. The apparatus of claim 13, wherein:

said spacer sleeve having said opening is provided with an outwardly extending annular flange between said opening and one end engaging said annular valve seat member of the fluid flow control means;

said spacer sleeve annular flange and said valve seat carrier outwardly projecting annular collar having a plurality of spaced longitudinal openings in longitudinal alignment with each other, respectively; and wherein said electrical conductors extend through said openings for substantially fixedly positioning of a portion of each conductor substantially adjacent the tubular body inner wall between the tubular body inner wall and the closure element in spaced substantially parallel longitudinal relationship to each other.

15. The apparatus of claim 14, including:

a plurality of substantially rigid tubular members extending through said longitudinally aligned openings and respectively substantially fixedly mounted with said spacer sleeve annular flange and said valve carrier annular collar, said tubular members extending substantially longitudinally between the tubular body inner wall and the closure element in substantially parallel spaced relationship relative to each other, each of said tubular members having one of said conductors extending longitudinally substantially axially therethrough and having a composite reinforcing and insulating material filled in an annular space between each conductor and each substantially rigid tubular member inner wall.

* * * * *